US006142838A

United States Patent [19]

Shinchi

[11] Patent Number: 6,142,838

[45] Date of Patent: Nov. 7, 2000

[54] CONNECTING STRUCTURE BETWEEN COVERED WIRE AND TERMINAL

[75] Inventor: Akira Shinchi, Shizuoka-ken, Japan

[73] Assignee: Yazaki Corporation, Tokyo, Japan

[21] Appl. No.: 09/003,364

[22] Filed: Jan. 6, 1998

[30] Foreign Application Priority Data

Jan. 9, 1997 [JP] Japan ..... 9-002330

[51] Int. Cl.[7] ..... H01R 4/02

[52] U.S. Cl. ..... 439/874; 439/421; 228/110.1

[58] Field of Search ..... 439/874, 736, 439/606, 409, 407, 399, 459; 228/110.1, 608

[56] References Cited

U.S. PATENT DOCUMENTS

| | | | |
|---|---|---|---|
| 4,350,404 | 9/1982 | Clark et al. | 439/399 |
| 5,122,065 | 6/1992 | Dudek et al. | 439/608 |
| 5,217,389 | 6/1993 | Mackay et al. | 439/459 |
| 5,222,811 | 6/1993 | Miyoshi | 439/874 |
| 5,520,550 | 5/1996 | Okabe | 439/404 |
| 5,662,493 | 9/1997 | Reichle | 439/409 |
| 5,711,067 | 1/1998 | Jenner et al. | 439/736 |
| 5,857,259 | 1/1999 | Johnston | 439/736 |

FOREIGN PATENT DOCUMENTS

| | | | |
|---|---|---|---|
| 7-70345 | 7/1995 | Japan . | |
| 966887 | 8/1964 | United Kingdom | 1/1 |

*Primary Examiner*—Gary F. Paumen
*Assistant Examiner*—Katrina Davis
*Attorney, Agent, or Firm*—Finnegan, Henderson, Farabow, Garrett & Dunner, L.L.P.

[57] ABSTRACT

A connecting structure for connecting a covered wire to a terminal is provided. The connecting structure includes a first member and a second member to be laid on the first member. In arrangement, the terminal is interposed between the first member and the second member. The covered wire having core lines covered with an insulating cover is disposed on the terminal. In order to spread the core lines on the terminal, the first member is provided with a projection which extends perpendicular to a direction of the core lines of the covered wire. In manufacturing, the insulating cover is molten by vibrating the second member on the covered wire by ultrasonic waves. Consequently, the core lines are forcibly brought into contact with an end of the projection having a small frictional resistance. Thus, the core lines of the covered wire can be uniformly spread to increase contact area between the core lines and the terminal.

10 Claims, 5 Drawing Sheets

CONNECTING STRUCTURE BETWEEN COVERED WIRE AND TERMINAL

BACKGROUND OF THE INVENTION

The present invention relates to a connecting structure between a terminal and a covered wire having core lines covered with an insulating cover, the connecting structure being obtained by mounting the covered wire on the terminal and sequentially fusing the insulating cover by ultrasonic energy under pressure, thereby electrically connecting the terminal with the core lines of the wire.

Japanese Unexamined Patent Publication (Kokai) No. 7-70345 discloses a conventional connecting structure where a covered wire and a terminal are interposed between a first member and a second member. Both of the first and second members are made of plastic materials which are soluble in each other by ultrasonic oscillation.

In this connecting structure, the first member is provided with a plurality of grooves, while the second member is provided with a plurality of projections for respective engagement with the grooves. In order to connect the terminal with the covered wire, the terminal is firstly accommodated in one of the grooves and the wire is mounted on a wire mounting surface of the terminal in succession. Then, the second member is laid on the first member so that the projections engage in the grooves, respectively. Next, under such a condition, the first and second members are vibrated by the ultrasonic waves while exerting a pressure on both members. Consequently, owing to this ultrasonic oscillation, the insulating cover is fused, so that the exposed core lines come into electrical contact with the terminal. Simultaneously, the first member is also welded to the second member into one body, thereby completing the integrated connecting structure.

While, in the above-mentioned connecting structure, since the above wire mounting surface of the terminal is shaped to be flat, it often happens that, in spite of pressing the core line on the terminal, the core lines come in contact with the terminal in their stacked manner without spreading uniformly. In such a case, there may be caused a problem that the contact resistance between the terminal and the core lines is increased due to a reduction of contact area therebetween.

SUMMARY OF THE INVENTION

It is therefore an object of the present invention to provide a connecting structure between a covered wire and a terminal, by which the plurality core of lines can be spread uniformly while untying the core lines crossing at the time of connecting the covered wire with the terminal by the ultrasonic oscillation, whereby the contact area therebetween can be increased to attain a conductive condition.

The object of the present invention described above can be accomplished by a connecting structure for connecting a covered wire to a terminal, the connecting structure comprising:

a first member;

a second member to be laid on the first member;

the terminal interposed between the first member and the second member; and the covered wire disposed on the terminal, the covered wire having core lines covered with an insulating cover;

wherein at least either one of the first member and the terminal is provided with a projection which extends perpendicular to a direction of the core lines of the covered wire, for spreading the core lines thereon laterally;

whereby the core lines are electrically connected with the terminal since the insulating cover is molten by vibrating the second member on the covered wire by ultrasonic waves while pressing the covered wire through the second member.

With the above-mentioned arrangement, when the insulating cover is molten by the ultrasonic oscillation, the core lines are forcibly brought into contact with an end of the projection having a small frictional resistance in comparison with that of a flat surface. Thus, the plural core lines of the covered wire can be spread uniformly thereby to increase contact area between the core lines and the terminal.

In the above-mentioned arrangement, preferably, the projection is formed on a base plate of the terminal. In this case, such a projection would be provided by a slight modification of the terminal configuration. Furthermore, since a spread of the core lines is executed on the terminal, it would be effective to increase the contact area between the core lines and the terminal.

More preferably, the projection is constituted by a portion of the base plate, which is being bent in a wave. In such a case, the producing of the projection would be facilitated owing to the partial bending of the base plate in a wave.

Alternatively, the projection may be constituted by a portion of the base plate, which is formed so as to project from a side edge of the base plate and folded so as to overlap with a remaining part of the base plate. Also in this case, producing of the projection would be facilitated owing to the partial folding of the base plate.

According to the present invention, the above object of the invention can be also accomplished by a connecting structure for connecting a covered wire to a terminal, the connecting structure comprising:

a first member;

a second member to be laid on the first member;

the terminal interposed between the first member and the second member; and the covered wire disposed on the terminal, the covered wire having core lines covered with an insulating cover;

wherein the terminal is provided with a plurality of projections which extend perpendicular to a direction of the core lines of the covered wire, for spreading the core lines thereon laterally;

whereby the core lines are electrically connected with the terminal since the insulating cover is molten by vibrating the second member on the covered wire by ultrasonic waves while pressing the covered wire through the second member.

Similarly to the previously mentioned invention, it is preferable that the projections of the above connecting structure are also formed on a base plate of the terminal.

More preferably, the terminal is provided, on an upper face of the base plate, with a plurality of dents and protrusions, both of which extend parallel to each other and perpendicular to a direction of the core lines of the covered wire. In this case, the protrusions constitute the present projections for spreading the core lines thereon laterally.

In this case, if only forming the plural dents and protrusions on the base plate, the above structure can be easily provided by, for example, a serration milling. In addition, owing to the arrangement where the protrudings are juxtaposed in series, it is possible to spread the core lines in a wide range, thereby being effective in increasing the contact area between the core lines and the terminal.

Alternatively, it is also preferable that the terminal further comprises a pair of elastic pusher plates which are arranged on the base plate so as to extend in a longitudinal direction of the base plate and obliquely upward in opposite directions and each of the elastic pusher plates has an opening which is formed for passing the covered wire therethrough and which is defined by at least one margin disposed above the base plate. In this case, the above margins constitute the present projections for spreading the core lines thereon laterally.

According to the structure, owing to the provision of the openings, the margins allow the core lines to be spread certainly. Moreover, since the core lines are depressed by the elastic pusher plates, the wire retaining force of the structure can be increased.

In this case, it is more preferable that the elastic pusher plates are connected with each other through a portion of the base plate. In such a case, the elastic pusher plates can be manufactured by bending the base plate partially.

Or again, the terminal may have a plurality of recesses formed on the base plate, each of the recesses being arranged between the adjoining projections. In this case, the terminal further comprises an elastic pusher plate which is arranged on the base plate, for interposing the covered wire together with the base plate, the elastic pusher plate having a plurality of dents formed for respective engagement with the projections on the base plate and a plurality of protrudings formed for respective engagement with the recesses.

In this structure, with the above engagement, it is possible to spread the core lines furthermore.

These and other objects and features of the present invention will become more fully apparent from the following description and appended claims taken in conjunction with the accompany drawings.

BRIEF DESCRIPTION OF THE DRAWINGS

FIGS. 1A and 1B show a first embodiment of the present invention, in which:

FIG. 1A is a perspective view of a connecting structure consisting of a terminal, a connector housing and a cover; and FIG. 1B is a cross sectional view of a wire connecting part of the connecting structure;

FIGS. 2A and 2B are explanatory views showing respective operations of the present connecting structure and the conventional connecting structure, in which:

FIG. 2A shows the present connecting structure where the core lines are uniformly spread owing to the provision of a projection; and FIG. 2B shows the conventional connecting structure where the core lines are non uniformly speed;

FIGS. 7A, 7B and 7C are explanatory views of the terminal of the connecting structure in accordance with a sixth embodiment of the present invention, in which:

FIG. 7A is a perspective view of the terminal before use;

FIG. 7B is a side view of the terminal having the covered wire inserted; and FIG. 7C is a side view of the terminal welded to core lines of the covered wire by ultrasonic oscillation.

DESCRIPTION OF THE PREFERRED EMBODIMENT

Embodiments of the present invention will be described with reference to the drawings.

Figure 1A:
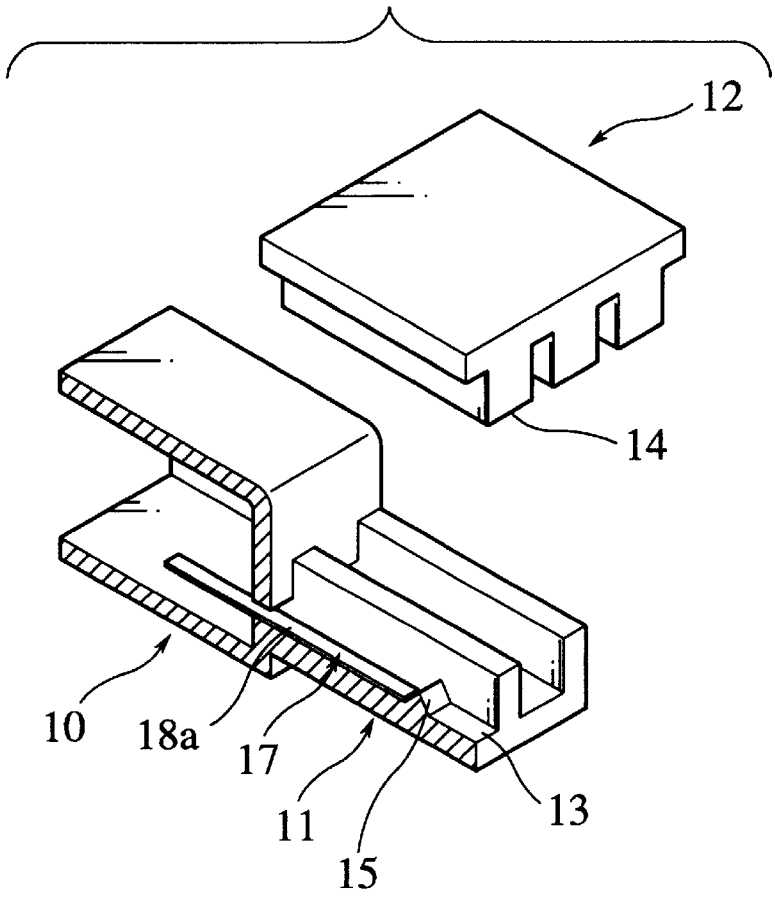
Figure 1B:
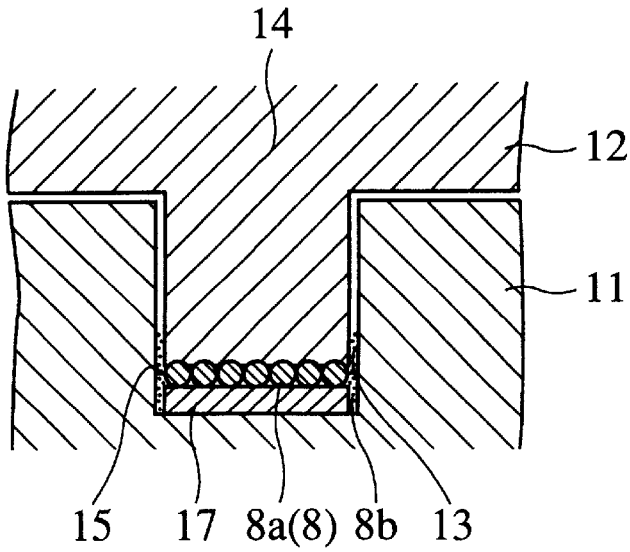

FIGS. 1A and 1B are explanatory views of a connecting structure of the first embodiment of the present invention, in which FIG. 1A is a perspective view showing a relationship among a terminal, a connector housing body and a cover body and FIG. 1B is a cross sectional view of a wire connecting part of the structure.

In the figures, reference numeral 10 designates a connector housing body, 12 a cover body and 17 a terminal. The terminal 17 is shaped of a flat plate. The connector housing body 10 and the cover body 12 are made from resinous materials which are soluble in each other by ultrasonic oscillation. The connector housing body 10 is provided, at a rear end thereof, with a projecting terminal retainer 11. While, the cover body 12 is formed so as to close the terminal retainer 11. The terminal retainer 11 is provided with a plurality of grooves 13 for engagement with a plurality of projections 14 formed on the cover body 12. Further, the terminal retainer 11 includes a projection 15 formed on a bottom of the groove 13 to have a sharp-pointed tip.

This projection 15 is formed so as to extend perpendicular to a direction to accommodate a covered wire 8. Additionally, having the tip butting against core lines 8*a* of the wire 8, the projection 15 serves to spread the core lines 8*a* laterally. Further, the projection 15 has functions to position a rear end of the terminal 17 and interpose the covered wire 8 by the fusing with the cover body 12. For this, the projection 15 is arranged so as to coincide with a rear end of a setting position for the terminal 17.

In order to complete the connecting structure between the covered wire 8 and the terminal 17, as shown in FIG. 1A, a wire connecting part of the terminal 17 is firstly accommodated in one of the grooves 13 formed in the terminal retainer 11 of the connector housing body 10 and subsequently, the covered wire 8 is mounted on the terminal 17. Next, the cover body 12 is overlaid on the connector housing body 10 while the projections 14 are inserted into the grooves 13 of the terminal retainer 11. In this state, an appropriate clearance is ensured between the cover body 12 and the terminal retainer 11, for example, between a top surface of the terminal retainer 11 and a lower surface of the cover body 12, for concentrating ultrasonic waves to a target point.

Under such a condition, the ultrasonic oscillation, i.e. vertical vibrations by the ultrasonic waves, is applied on the cover body 12 by an ultrasonic horn (not shown) which presses the body 12 simultaneously. Thus, the resultant ultrasonic energy concentrates in the projection 14 interposing the covered wire 8 together with the bottom surface of the groove 13, so that an insulating cover 8*b* of the wire 8 is fused to expose core lines 8*a*. Then, since the projections 14 are urged downward, the fused cover 8*b* is excluded from a bottom wall 18 of the terminal 17, whereby the core lines 8*a* can be electrically connected with the wall 18.

Then, when the insulating cover 8*b* is molten by the ultrasonic oscillations, the plurality of core lines 8*a* are spread uniformly since they are forcibly urged against the projection 15 having a frictional resistance smaller than that of a flat surface. Consequently, the contact area between the core lines 8*a* and the terminal 17 can be increased while the conductive resistance therebetween is reduced. In this way, the projection 15 is finally welded to the cover body 12, whereby the connecting structure having the core lines 8*a* embedded therein and exhibiting an increased retaining force for the wire 8 can be completed. Note, it will be understood that, owing to its positioning adjacent to the rear end of the terminal 17, the projection 15 also serves to prevent the terminal 17 from moving back.

Figure 2A:
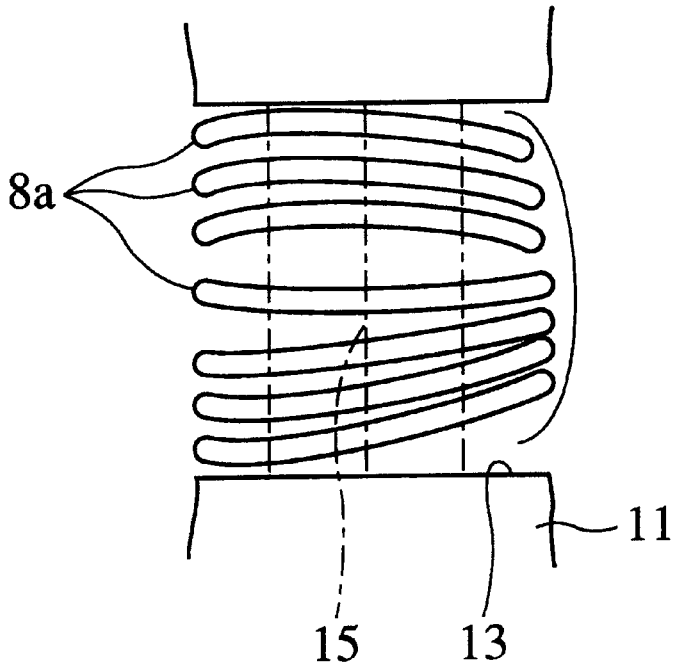
Figure 2B:
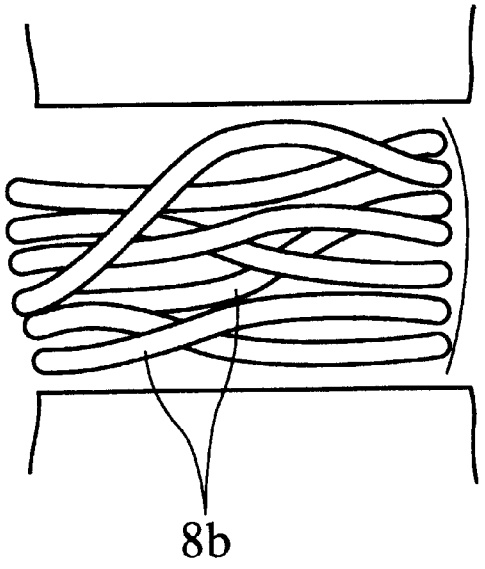

FIGS. 2A and 2B show respective conditions of the spreading core lines 8*a* in case of providing the projection 15 of the invention and not providing it as a comparison. From these figures, it will be understood that the core lines 8*a* can be uniformly spread on the projection 15, while they are crossed or overlapped with each other in case that the projection 15 is not provided.

Note, although it is preferable that the projection 15 is formed just behind the rear end of the terminal 17, the projection 15 may be disposed apart from the terminal 17 to a certain extent so long as the former exists in the vicinity of contacts between the terminal 17 and the core lines 8*a*. However, it should be noted that such an excess separation of the projection 15 from the terminal 17 would cause the undesirable mutual crossing among the core lines 8*a* at a critical contact area in spite of their spreading owing to the projection 15.

In the modifications, the above-mentioned projection may be provided on an upper surface of the terminal directly. Such a terminal will be described as below.

Figure 3:
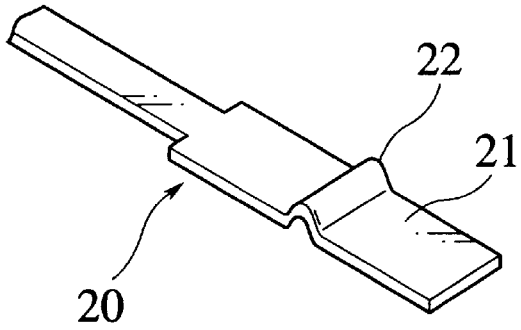
FIG. 3 is a perspective view of the terminal of the connecting structure in accordance with a second embodiment of the present invention.

FIG. 3 shows a terminal 20 in accordance with the second embodiment of the invention.

In the terminal 20, a projection 22 can be formed by simply bending a portion of a base plate 21 like a wave. Therefore, in the embodiment, it is easy to produce the projection 22 in the terminal 20.

Figure 4:
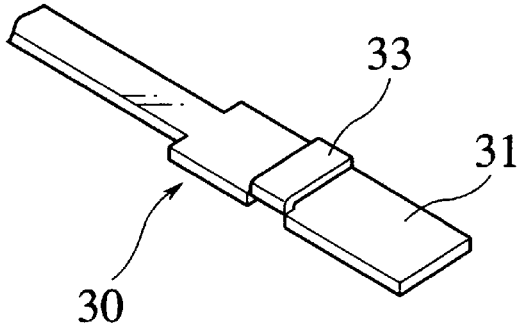
FIG. 4 is a perspective view of the terminal of the connecting structure in accordance with a third embodiment of the present invention.

FIG. 4 shows a terminal 30 of the third embodiment of the invention.

In the terminal 30, a projection 33 is provided by folding back a piece extending from a side edge of a base plate 31 so as to overlap with a remaining part of the base plate 31. Also in this embodiment, the provision of the projection 33 is easy owing to the workers' folding operation of the extended piece.

Figure 5:
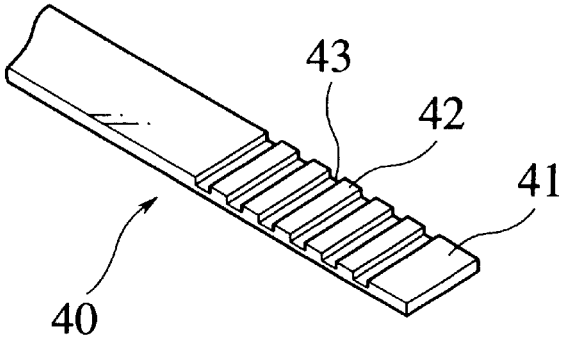
FIG. 5 is a perspective view of the terminal of the connecting structure in accordance with a fourth embodiment of the present invention.

FIG. 5 shows a terminal 40 in accordance with the fourth embodiment of the present invention. According to the embodiment, the terminal 40 is provided, on an upper face of a base plate 41, with of a plurality of grooves 43 and protrusions 42, both of which extend perpendicular to an extending direction of the core lines of the wire. In the terminal 40, the plural grooves 43 and the protrusions 42 can be easily obtained by serration milling of a top face of the base plate 41. According to the embodiment, since the protrusions 42 are formed on the base plate 41 in series, it is possible to spread the core lines in a wide range, whereby the increasing of contact area between the core lines and the terminal 40 can be effected.

Figure 6:
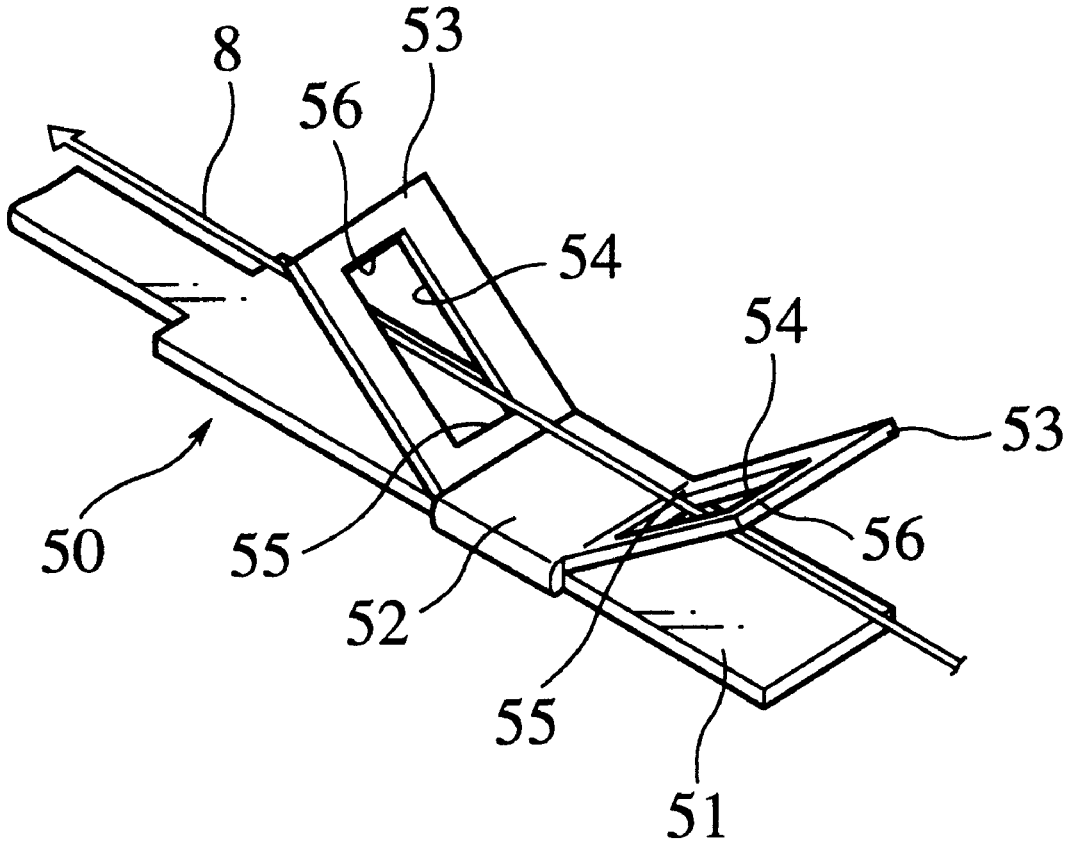
FIG. 6 is a perspective view of the terminal of the connecting structure in accordance with a fifth embodiment of the present invention.

FIG. 6 shows a terminal 50 of the fifth embodiment of the present invention.

According to the embodiment, the terminal 50 is provided, on a base plate 51 thereof, with a pair of elastic pusher plates 53 which are slanted in the opposite directions and connected with each other through an intermediate piece 52. Each elastic pusher plate 53 has an rectangular opening 54 formed for passing the covered wire 8 therethrough. According to the embodiment, a lower margin 55 defining the opening 54 operates as the above-mentioned projection for spreading the core lines of the wire 8. It should be noted that, depending on the circumstances, an upper margin 56 of the opening 54 could fulfill the lower edge's function similarly.

In assembling, the cover body 12(FIG. 1A) is laid on this terminal retaining part on condition that the covered wire 8 is inserted into the openings 54. Consequently, since the slanted elastic pusher plates 53 are depressed by the cover body, the lower margins 55 and the upper margins 56 come into contact with the exposed core lines resulting from fusing of the insulating cover, thereby serving to spread the plural core lines. In addition, since the elastic pusher plates 53 exert a bending force on the core lines, it is possible to progress the terminal's force to retain the core lines.

Figure 7A:
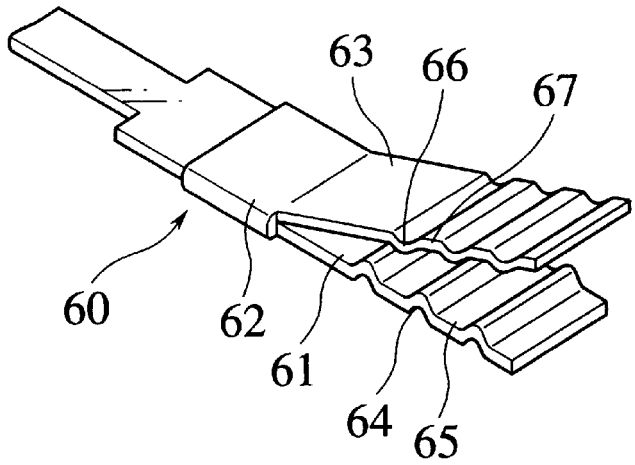

FIG. 7A shows a terminal 60 in accordance with the sixth embodiment of the invention.

In the terminal 60, projections 64 and recesses 65 are alternately provided by forming a base plate 61 in waves. Further provided above the base plate 61 is an elastic pusher plate 63 which can interpose the covered wire between the base plate 61 and the plate 63 when it is depressed. The elastic pusher plate 63 is provided by folding a piece extending from a side edge of the base plate 61 so as to overlap with the remaining part of the base plate 61. Further, the base plate 63 is formed in a manner that a leading end thereof extends obliquely upward and rearward. On the base plate 63, a plurality of grooves 67 and protrusions 66 are alternately formed so as to opposing the projections 64 and the recesses 65, respectively.

Figure 7B:
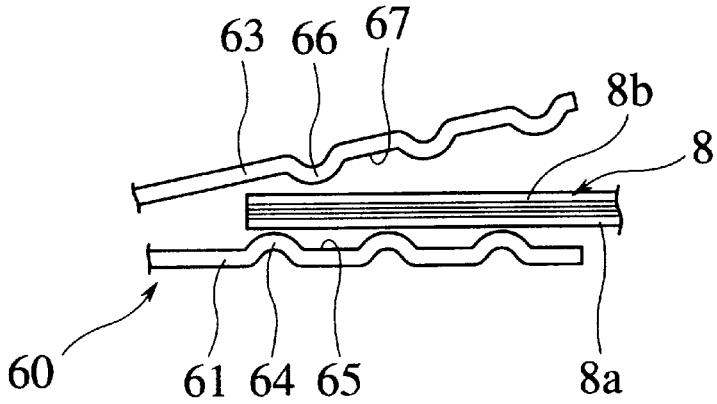
Figure 7C:
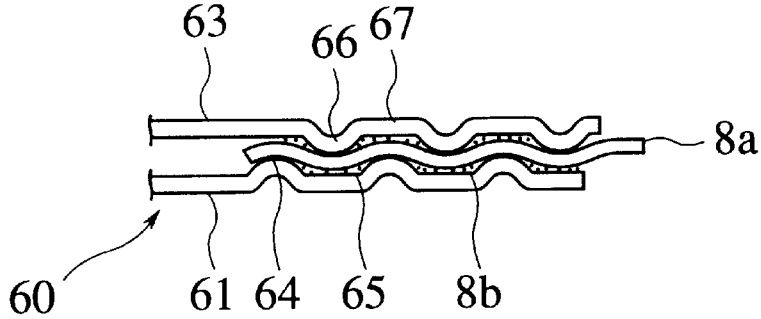

In order to assemble the covered wire 8 in the terminal 60, as shown in FIG. 7B, the not-shown cover body is laid on a terminal retaining part of the terminal 60 under condition that the covered wire 8 is inserted between the base plate 61 and the pusher plate 63. Consequently, with the depression of the cover body, a clearance between the depressed elastic pusher plate 63 and the base plate 61 is gradually decreased, so that the projections 64 on the base plate 61 and the protrusions 66 on the pusher plate 63 come into contact with the exposed core lines 8*a* resulting from fusing of the insulating cover 8 while serving to spread the plurality of core lines 8*a*, as shown in FIG. 7C. In this way, with the respective engagement of the projections 64 and the protrusions 66 with the dents 67 and the recesses 65, the core lines 8*a* can be securely interposed between the base plate 61 and the elastic pusher plate 63, thereby to accomplish the high retaining force for the wire 8.

Finally, it will be understood by those skilled in the art that the foregoing descriptions relate to six embodiments of the disclosed connecting structure, and that various changes and modifications may be made to the present invention without departing from the spirit and scope thereof.

What is claimed is:

1. A connecting structure for connecting a covered wire to a terminal, said connecting structure comprising:

a first member;

a second member to be laid on said first member;

said terminal interposed between said first member and said second member;

said covered wire disposed on said terminal, said covered wire having an insulating cover;

wherein said first member and/or said terminal is provided with a projection which extends perpendicular to a direction of said covered wire, for spreading a plurality of covered wires thereon laterally;

whereby said covered wires are electrically connected with said terminal due to said insulating cover being molten by vibrating said second member on said covered wire by ultrasonic waves while pressing said covered wire through said second member.

2. A connecting structure as claimed in claim 1, wherein said projection is formed on a base plate of said terminal.

3. A connecting structure as claimed in claim 2, wherein said projection is constituted by a portion of said base plate, said portion being bent in a wave.

4. A connecting structure as claimed in claim 2, wherein said projection is constituted by overlapping said base plate with a rectangular portion of said base plate extending from a side edge of said base plate.

5. A connecting structure for connecting a covered wire to a terminal, said connecting structure comprising:

a first member;

a second member to be laid on said first member;

said terminal interposed between said first member and said second member; and said covered wire disposed on said terminal, said covered wire having an insulating cover;

wherein said terminal is provided with a plurality of projections which extend perpendicular to a direction of said covered wire, for spreading a plurality of covered wires thereon laterally;

whereby said plurality of covered wires are electrically connected with said terminal due to said insulating cover being molten by vibrating said second member on said covered wire by ultrasonic waves while pressing said covered wire through said second member.

6. A connecting structure as claimed in claim 5, wherein said projections are formed on a base plate of said terminal.

7. A connecting structure as claimed in claim 6, wherein said terminal is provided, on an upper face of said base plate, with a plurality of grooves which extend parallel to each other and perpendicular to a direction of said covered wire and wherein said grooves define said projections for spreading said plurality of covered wires thereon laterally.

8. A connecting structure as claimed in claim 6, wherein said terminal has a plurality of recesses formed on said base plate, each of said recesses being arranged between the adjoining projections, and wherein said terminal further comprises an elastic pusher plate which is arranged on said base plate, for interposing said covered wire together with said base plate, said elastic pusher plate having a plurality of grooves formed for respective engagement with said projections on said base plate and a plurality of protrusions formed for respective engagement with said recesses.

9. A connecting structure as claimed in claim 6, wherein said terminal further comprises a pair of elastic pusher plates which are arranged on said base plate so as to extend in a longitudinal direction of said base plate and obliquely upward in opposite directions and wherein each of said elastic pusher plates has an opening which is formed for passing said covered wire therethrough and which is defined by at least one margin disposed above said base plate, said margin constituting said projection for spreading said core lines thereon laterally.

10. A connecting structure as claimed in claim 9, wherein said elastic pusher plates are connected with each other through a portion of said base plate.

* * * * *